US007478494B2

(12) United States Patent
Zeh

(10) Patent No.: US 7,478,494 B2
(45) Date of Patent: Jan. 20, 2009

(54) REPEATING WEAPON

(75) Inventor: Meinrad Zeh, Weitnau (DE)

(73) Assignee: Blaser Finanzholding GmbH, Isny Im Allgau (DE)

( * ) Notice: Subject to any disclaimer, the term of this patent is extended or adjusted under 35 U.S.C. 154(b) by 552 days.

(21) Appl. No.: 11/127,774

(22) Filed: May 12, 2005

(65) Prior Publication Data

US 2006/0090387 A1 May 4, 2006

(30) Foreign Application Priority Data

May 13, 2004 (DE) ..... 10 2004 023 555

(51) Int. Cl.
*F41A 3/12* (2006.01)

(52) U.S. Cl. ..... 42/25; 89/26

(58) Field of Classification Search ..... 89/26; 42/25

See application file for complete search history.

(56) References Cited

U.S. PATENT DOCUMENTS 1,834,410 A * 12/1931 Loomis ..... 42/21
2,811,902 A * 11/1957 Dixon ..... 89/165
3,882,625 A 5/1975 Iellie
4,163,334 A * 8/1979 Tollinger ..... 42/25
6,966,137 B2 * 11/2005 Gussalli Beretta ..... 42/46

FOREIGN PATENT DOCUMENTS

| | | |
|---|---|---|
| DE | 358357 | 9/1922 |
| DE | 7124565 | 11/1971 |
| DE | 2 402 445 | 8/1974 |
| DE | 43 05 700 C1 | 10/1994 |

* cited by examiner

*Primary Examiner*—Stephen M Johnson
(74) *Attorney, Agent, or Firm*—Martin Fleit; Paul Bianco; Fleit Gibbons Gutman Bongini & Bianco PL

(57) ABSTRACT

The invention relates to a repeating weapon, especially to a repeating rifle, with a cartridge chamber and a bolt block, which contains a bolt that can move relative to the cartridge chamber and that can be locked by means of a locking device in a closed position. For improving the safety against elevated gas pressure, the cartridge chamber is embodied such that a cartridge can be pushed completely into the cartridge chamber and the cartridge chamber has a rear sealing surface sealing flush with the case bottom of the cartridge for contacting a breech block on a front bolt head of the bolt.

12 Claims, 4 Drawing Sheets

REPEATING WEAPON

FIELD OF THE INVENTION

The invention relates to a repeating weapon, particularly to a repeating rifle.

BACKGROUND OF THE INVENTION

Such a repeating weapon is known from DE 43 05 700 C1. In this publication, the locking bolt and a locking case, arranged concentrically around this locking bolt, are arranged within a bolt holder that can move on a system block. Through the locking case embodied as an expanding casing, the locking bolt provided with an expanding cone can be locked in a closed position. In such repeating rifles, the cartridge chamber is usually embodied such that the case bottom and the extractor groove of the cartridge project out of the cartridge chamber toward the rear when the cartridge is inserted. The locking bolt contains at its front end a bolt head with a front annular collar, which encloses the end of the cartridge projecting rearward out of the cartridge chamber in the locked position of the locking bolt. In this way, protection against elevated gas pressure is achieved. The annular collar of the bolt head is dimensioned so that safety is guaranteed even at a significantly elevated gas pressure.

Typically, weapons undergo extensive testing before sale in order to ensure the reliability of their safety even under exceptional conditions. In these tests, the maximum usable gas pressure is also significantly exceeded in order to test the stability of the weapon and to be able to exclude safety risks as much as possible. Nevertheless, improper handling or the use of defective or improperly loaded ammunition can lead to damage to the weapon and sometimes even to personal injury. Severely exceeded gas pressure due to improperly loaded ammunition represents a danger for all weapons.

The problem of the invention is to create a repeating weapon which exhibits even more improved safety against elevated gas pressure.

SUMMARY OF THE INVENTION

This problem is solved by a repeating weapon according to the present invention.

In the repeating weapon according to the invention, the cartridge chamber is embodied such that the cartridge can be pushed completely into the cartridge chamber and that the cartridge chamber has a rear sealing surface sealing flush with the case bottom of the cartridge for forming a breech block of the bolt. Thus, the cartridge is surrounded over its entire length on the outside by the stable cartridge chamber. Even the cartridge end that is especially sensitive to stoppage due to a broken case is arranged within the cartridge chamber, which improves the safety against stoppage due to a broken case and the safety against unexpectedly high gas pressure. At the rear, the cartridge chamber can be sealed by a straight front surface of the bolt. At the bolt head of the bolt, no separate protective cases or the like have to be provided.

In a useful configuration of the invention, a lateral recess for the engagement of a cartridge extractor arranged on the bolt head of the bolt is provided in the rear sealing surface of the cartridge chamber. This recess can be relatively small, so that the cartridge is also nearly completely enclosed by the cartridge chamber in this region. The cartridge extractor is arranged so that it projects forward into a lateral groove of the bolt head in an advantageous configuration.

For ejecting the spent cartridge cases, a recess for holding a cartridge extractor that can move in the axial direction of the bolt between a closed position and an ejecting position is provided on the bolt head of the bolt. It is useful if the cartridge ejector is configured in the shape of a plate adapted to the outer contours of the bolt head with a front end surface, which seals flush with the breech block of the bolt head in the closed position. The cartridge ejector is configured in an advantageous configuration as an essentially U-shaped plate. However, the cartridge ejector can also be formed as a circular, annular, or segmented plate. The breech block and the front end surface form a continuous, flat sealing surface, by means of which the cartridge chamber is sealed at the rear. Through the special shape of the cartridge ejector, a clean guidance of the cartridge during insertion is ensured and tilting of the case during ejection is prevented.

In one advantageous configuration, the locking device is configured as a locking case with spring-like locking elements activated by the bolt head of the bolt. However, other locking devices can also be used.

BRIEF DESCRIPTION OF THE DRAWINGS

Additional details and advantages of the invention emerge from the following description of a preferred embodiment with reference to the drawing. Shown are.

DETAILED DESCRIPTION OF THE INVENTION

Figure 1:
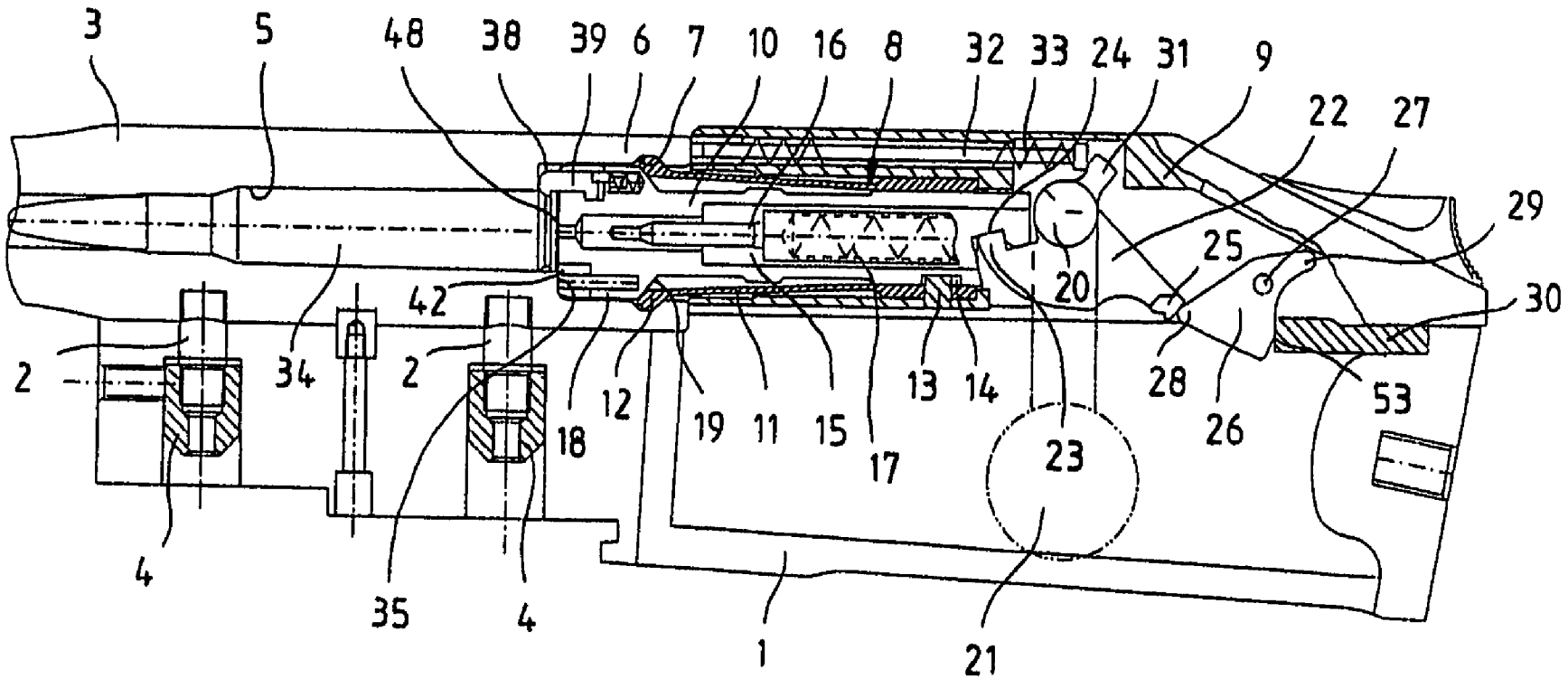
FIG. 1, a part of a repeating rifle with a bolt block in locked position.
Figure 2:
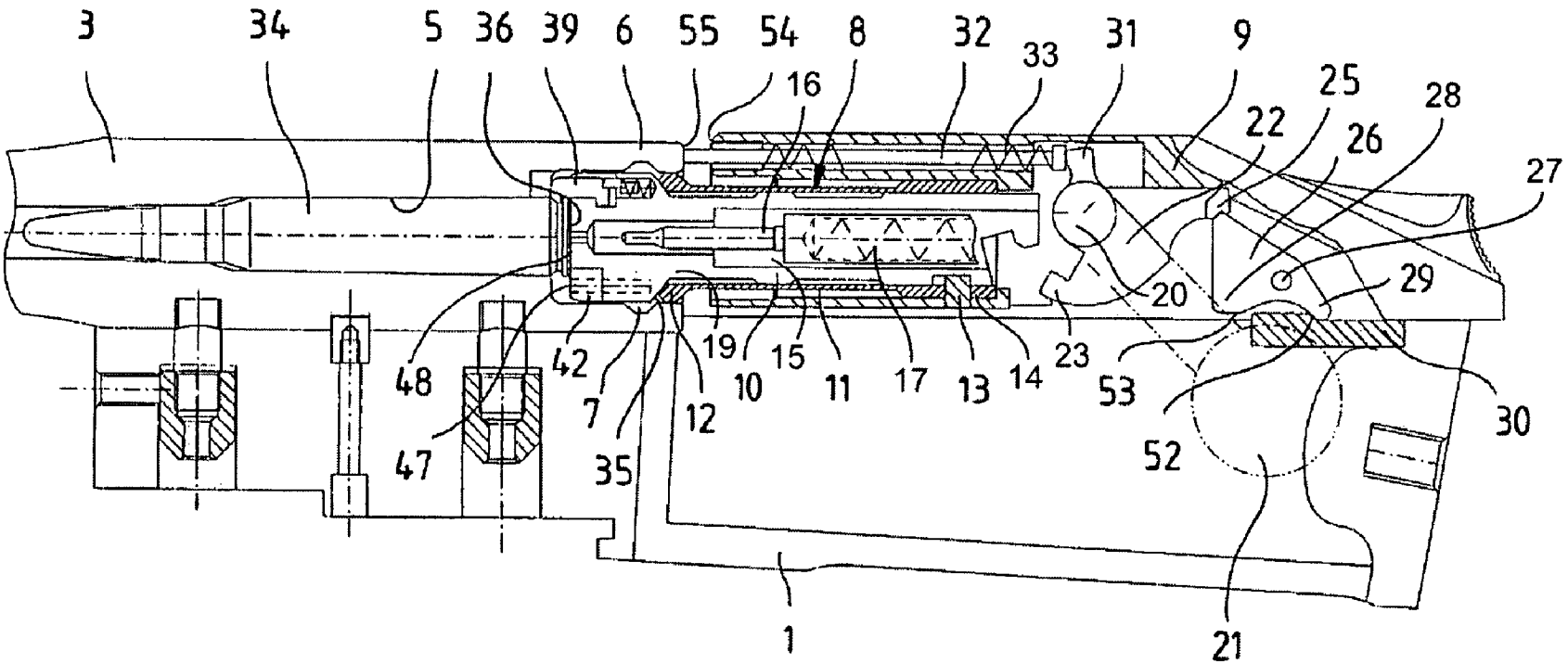
FIG. 2, the repeating rifle shown in FIG. 1 with the bolt block in the unlocked position.

The repeating rifle partially shown in FIGS. 1 and 2 contains a system block 1, on which a barrel 3 provided with fastening bolts 2 is mounted detachably by means of fastening nuts 4. At the rear end of the system block 1, a butt stock, which is not shown here, can be attached. The barrel 3 contains at its rear end a cartridge chamber 5 and a locking head 6, which contains on its inner wall a circular annular groove 7 for engaging a locking case 8. A bolt holder 9, which is embodied as a slide, which has an essentially cylindrical bolt 10, and which guides the locking case 8 concentrically surrounding the bolt 10, is guided on the system block 1, so that the bolt holder can move in the longitudinal direction of the barrel 3 relative to the cartridge chamber 5. The locking case 8 is configured as an expanding case and contains several spring tabs 11 divided by longitudinal slits on its front part, which have on their front ends a thicker section 12 for engaging in the annular groove 7 of the locking head 6. The locking case 8 is fixed on its rear end by means of a crosspiece 13 within the bolt holder 9.

The bolt 10 can move within the locking case 8 by a predetermined amount in the axial direction. The movement path is limited by the crosspiece 13 and a groove 14 provided on the outer side of the bolt 10. The groove 14 is somewhat wider than the crosspiece 13, which enables the relative movement of the bolt 10 and locking case 8. In a central through hole 15 of the cylindrical bolt 10, a firing pin 16 with a firing pin spring 17 is arranged. On its front end, the bolt 10 has bolt head 18 enlarged in diameter with a rear conical expanding surface 19, on which the spring tabs 11 of the locking case 8 are supported with their front end.

In a cross hole of the bolt holder 9, a shaft 20 running transverse to the barrel axis for a pivotable bolt handle 21 is mounted so that it can rotate. The shaft 20 of the bolt handle 21 is connected to a breech handle 22, which has a front hook 23 for engaging in a lateral recess 24 on the rear end of the bolt 10 and a rear projection 25 for interacting with a double-armed swivel lever 26 arranged at the rear on the breech handle 22. The swivel lever 26 is mounted in the bolt holder 9 so that it can pivot about a transverse axis 27. It contains a front lever arm 28 interacting with the breech handle 22 and a rear lever arm 29, which interacts with a control plate 30.

A cam 31, which is used for moving a trigger pin 32 guided movably in the bolt holder 9 in the barrel direction and biased rearward by a spring 33, is also connected to the shaft 20. Thus, the bolt handle 21 is forced into its locked position shown in FIG. 1 by the spring 33. The front end of the trigger pin 32 contacts the rear end surface of the locking head 6.

Figure 3:
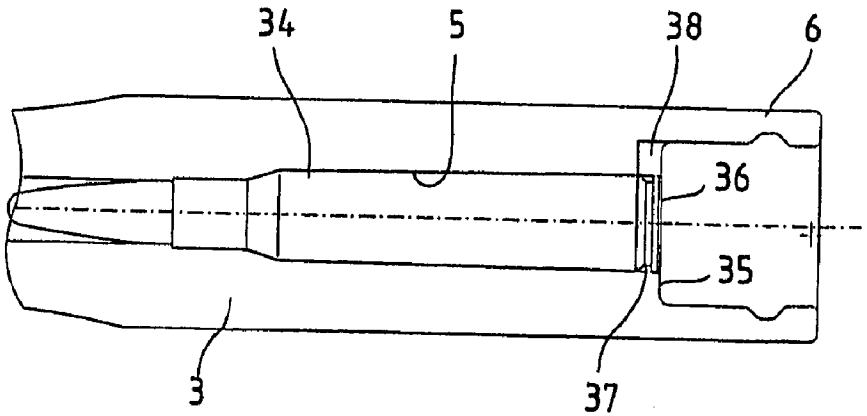
FIG. 3, a part of the barrel with the cartridge chamber in a longitudinal section and a rear view.
Figure 6:
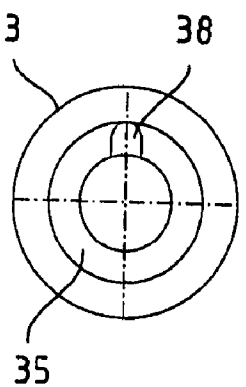
FIG. 6 is a rear view of the barrel shown in FIG. 3.

As follows especially from FIGS. 3 and 6, the cartridge chamber 5 is embodied such that a cartridge 34 can be inserted completely and a rear sealing surface 35 of the cartridge chamber is sealed flush with the case bottom 36 of the cartridge 34. Thus, the cartridge 34 no longer projects rearward from the cartridge chamber 5 with its case bottom 36 and is also enclosed at its extractor groove 37 by the cartridge chamber 5. In the rear sealing surface 35 of the cartridge chamber 5, there is only one small lateral recess 38 for engaging a cartridge extractor 39 shown in FIG. 4.

Figure 4:
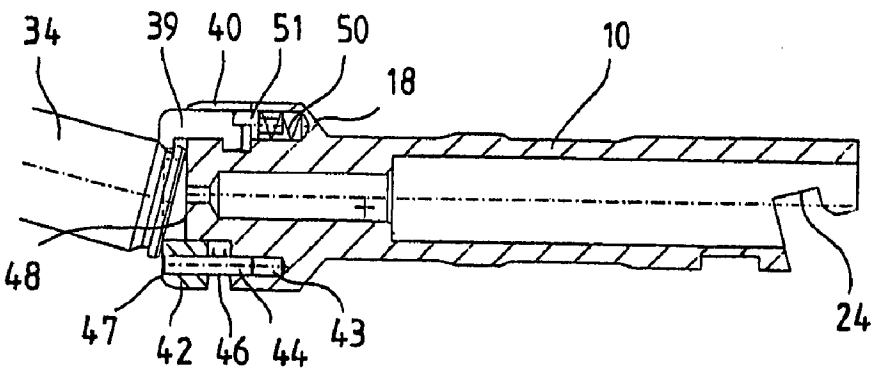
FIG. 4, a locking bolt in a longitudinal section.
Figure 5:
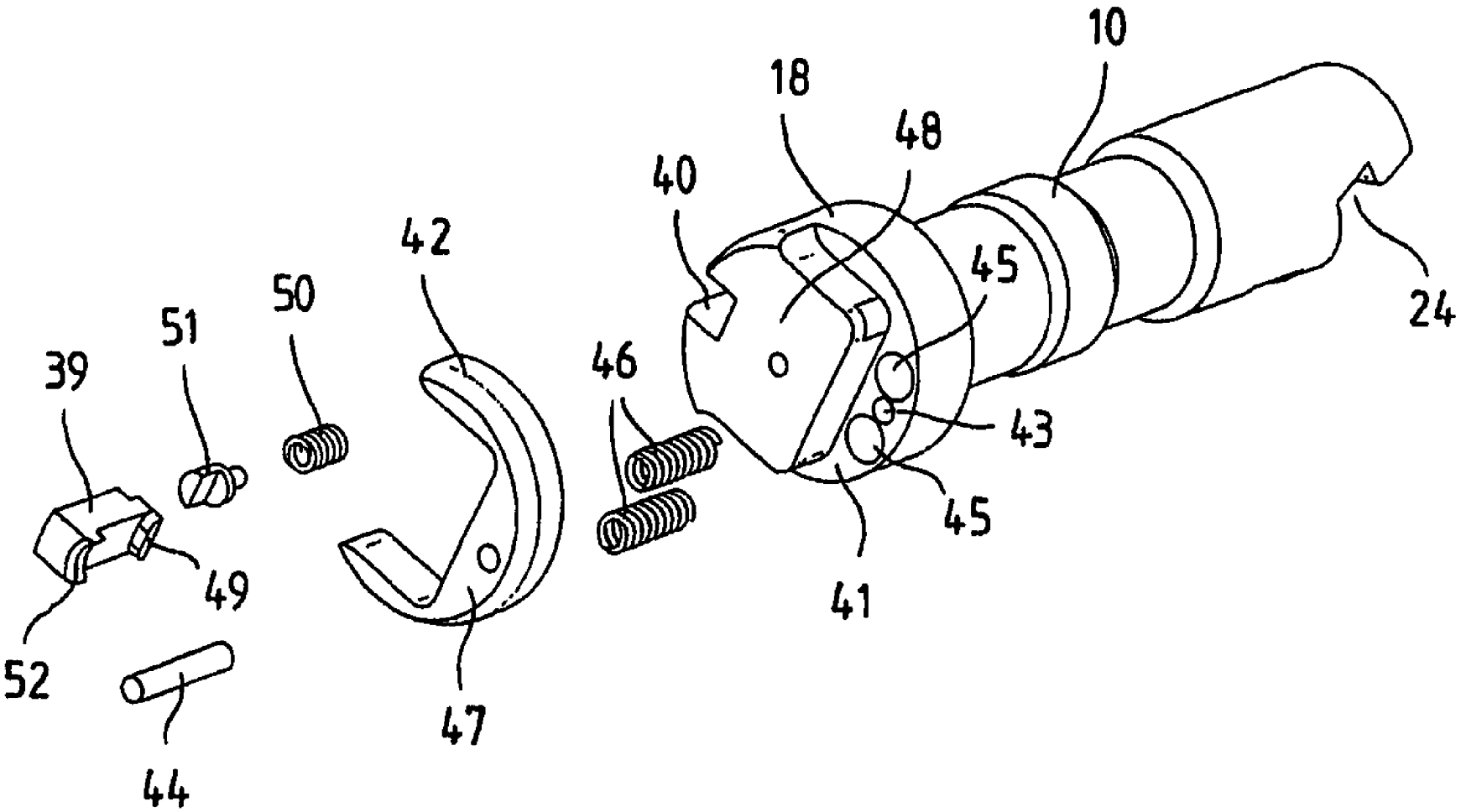
FIG. 5, the locking bolt shown in FIG. 4 in an exploded view.

The bolt 10 shown separately in FIGS. 4 and 5 contains at its bolt head 18 a lateral groove 40, in which the hook-shaped cartridge extractor 39 is arranged so that it projects forward. A recess 41, which essentially has a U shape in the front view, is further arranged on the bolt head 18 opposite the groove 40 for receiving a cartridge ejector 42 fitting in the recess 41. The cartridge ejector 42 is embodied in the shape of an essentially U-shaped plate fitted to the outer contours of the bolt head 18. The cartridge ejector 42 is arranged such that the cartridge extractor 39 lies between its legs. A hole 43 for receiving a guide pin 44 is formed in the recess 41. By means of the guide pin 44, the cartridge ejector 42 can move between an ejection position shown in FIG. 4 and a retracted closed position shown in FIG. 1. Next to the hole 43 are two other receiving holes 45 each for a compression spring 46, through which the cartridge ejector 42 is forced into the ejection position. The cartridge ejector 42 is protected against falling out by a safety element (not shown). The cartridge ejector 42 is embodied such that its front end surface 47 is sealed in the closed position flush with a front breech block 48 of the bolt 10. Thus, in the closed position, a flat sealing surface broken only by the groove 40 is realized.

The cartridge extractor 39 is laterally guided by an inner projection 49 so that it can move in the groove 40 of the bolt head 18. By means of a slide 51 biased by a compression spring 50, the cartridge extractor 39 is held in the groove 40 and biased such that a front hook piece 52 is forced inward for engagement in the extractor groove 37 of a cartridge.

The function of the bolt block on the previously described repeating rifle is explained below with reference to FIGS. 1 and 2.

In the locked position shown in FIG. 1, the breech block 48 seals the bolt 10 flush with the rear sealing surface 35 of the cartridge chamber 5. In this position, the cartridge ejector 42 is also pressed against the force of the springs 46 into the recess 41 and its front end surface 47 also contacts the rear sealing surface 35 of the cartridge chamber 5. The cartridge chamber 5 and the case bottom 36 of the cartridge 34 pushed completely into the cartridge chamber 5 are thus sealed at the rear by the breech block 48 and the front end surface 47 of the cartridge ejector 10. The cartridge extractor 39 engages in the recess 38 and in the extractor groove 37 of the cartridge 34 shown enlarged in FIG. 3. The spring tabs 11 of the locking case 8 are forced radially outward by means of the expanding surface 19 of the bolt head 18, so that the thicker sections 12 engage in the annular groove 7. In the locked position, the bolt handle 21 projects at a right angle to the barrel axis and the front hook 23 of the breech handle 22 engages in the recess 24 of the bolt 10.

For opening the bolt breech, the bolt handle 21 is pivoted rearward as shown in FIG. 2. In this way, the cam 31 presses on the rear end of the trigger pin 32, which is supported with its front end on the rear end side 55 of the locking head 6. In this way, the bolt holder 9 is pushed rearward and also takes along the locking case 8 connected rigidly to it, while the bolt 10 at first remains in its front position. When the locking case 8 moves backward relative to the bolt 10, the thicker sections 12 glide inward in the radial direction on the front end of the spring tabs 11 at the conical expanding surface 19, wherein the spring tabs 11 contact the outer surface of the thinner rear part of the bolt 10 due to their elasticity, and the thicker sections 12 are led out of engagement with the annular groove 7. For the further rearward shifting of the bolt holder 9, the crosspiece 13 takes along the bolt 10 and pulls this together with the locking case 8 from the locking head 6. In this way, the cartridge extractor 39 pulls the cartridge 34 from the cartridge chamber 5.

When the cartridge 34 loses its guidance within the cartridge chamber 5 for further retraction of the bolt holder 9, the cartridge ejector 42 is pressed forward by the two compression springs 46, whereby the cartridge 34 is ejected to the side according to FIG. 4.

For the displacement of the bolt holder 9 rearward, the control plate 30 turns the swivel lever 26 in the clockwise direction until the rear lever arm 29 is led into contact on the control plate 30. As soon as the swivel lever 26 has been turned completely upward by the control plate 30, the front lever arm 28 locks to a recess of the rear projection 25 of the breech handle 22, whereby the bolt handle 21 is blocked in the opened position.

With the aid of the bolt handle 21 blocked in the opened position, the bolt holder 9 can be pushed rearward and then forward again for reloading. When the bolt holder 9 has reached the position shown in FIG. 2 through forward pushing, the rear lever arm 29 of the swivel lever 26 is led into contact on a projection 52 of the control plate 30, whereby the swivel lever 26 is turned in the counterclockwise direction for the further forward movement of the bolt holder 9. In this way, the locking of the breech handle 22 and the blocking of the bolt handle 21 is triggered in the opened position. If the bolt handle 21 is then pivoted forward, the breech handle 22 turns with its rear projection 25 the swivel lever 26 in the counterclockwise direction until it is led with a rear surface 53 into an intermediate position not shown here for contact on the front end of the control plate 30. If the bolt handle 21 is then pivoted further forward, force is then transferred through the swivel lever 26, which assists the forward finger force and the bolt holder 9 is pushed forward.

Immediately before the front end surface 54 of the bolt holder 9 contacts the rear end surface 55 of the locking head 6 during its forward movement, the breech block 48 and the front end surface 47 of the rearward pressed cartridge ejector 42 on the bolt 10 contact the rear sealing surface 35 of the cartridge chamber 5, whereby the cartridge 34 is pushed completely into the cartridge chamber 5. In this way, further forward movement of the bolt 10 is stopped. If the bolt holder is then pushed farther forward into contact with the rear end surface 35 of the locking head 6, the locking case 8 connected rigidly to it via the crosspiece 13 also moves relative to the bolt 10, whereby the spring tabs 11 of the locking case 8 are pressed radially outward into the annular groove 7 by means of the conical expanding surface 19 of the bolt head 18, as shown in FIG. 1. Therefore, the bolt head 18 is supported at the rear.

When the bolt handle 21 pivots into the locked position according to FIG. 1, the breech handle 22 is led with its rear projection 25 through a dead-point position determined by the line connecting the support point of the swivel lever 26 on the control plate 30 and the rotational point of the shaft 20. By moving the breech handle 22 outward through the dead-point position, the locking case 8 is held in its locked position. The compression spring 33 acting on the cam 31 via the trigger pin 32 ensures that the breech handle 22 is held in its locked position. The breech handle 22 is also held in its locked position by the hook 23, which engages in the recess 24 of the bolt 10.

The previously described invention is not limited to a repeating rifle. It can also be used accordingly for other repeating weapons.

What is claimed is:

1. A repeating weapon for firing a cartridge with a case bottom, comprising:

a barrel having a cartridge chamber formed therein and a rear sealing surface behind said cartridge chamber, said rear sealing surface being sealingly flush with the case bottom of the cartridge when the cartridge is fully inserted in said cartridge chamber;

a bolt being movable relative to the cartridge chamber and lockable with a locking device into a closed position, said bolt having a front bolt head with an outer contour and a recess formed in said front bolt head, said bolt head having a breech block, said breech block, in the closed position of the bolt, being held flush with said rear sealing surface and with the case bottom of the cartridge when the cartridge is fully inserted in said cartridge chamber;

a bolt holder containing said bolt and connected to said barrel; and a cartridge ejector disposed in said recess in said front bolt head and being movable from a closed position to an ejection position when said bolt is moved axially in said bolt holder, said cartridge ejector having a U-shaped plate shape matching said outer contour of said bolt head and further having a front end surface, said front end surface, in the closed position of the bolt, sealing flush with said breech block against said rear sealing surface.

2. The repeating weapon according to claim 1, wherein said rear sealing surface has a lateral recess formed therein for receiving a cartridge extractor arranged on the bolt head of the bolt.

3. The repeating weapon according to claim 2, wherein the recess for the cartridge ejector is located on a side of the bolt head opposite the cartridge extractor.

4. The repeating weapon according to claim 2, wherein:

said bolt head has a later groove formed therein; and the cartridge extractor projects from said lateral groove of the bolt head of the bolt.

5. The repeating weapon according to claim 4, wherein the cartridge extractor has an inner projection retaining said cartridge extractor in the lateral groove of the bolt head.

6. The repeating weapon according to claim 4, further comprising:

a compressing spring; and a slide biased by a said compression spring urging said cartridge extractor outward from said bolt head.

7. The repeating weapon according to claim 1, wherein said cartridge ejector is a circular plate.

8. The repeating weapon according to claim 1, further comprising a guide pin disposed on said bolt, the cartridge ejector moving into the recess of the bolt head by traveling on said guide pin.

9. The repeating weapon according to claim 1, further comprising a compression spring urging said cartridge ejector into the ejection position.

10. The repeating weapon according to claim 1, wherein said cartridge ejector is an annular plate.

11. The repeating weapon according to claim 1, wherein said cartridge ejector is a segmented plate.

12. A repeating rifle for firing a cartridge with a case bottom, comprising:

a barrel having a cartridge chamber formed therein and a rear sealing surface behind said cartridge chamber, said rear sealing surface being sealingly flush with the case bottom of the cartridge when the cartridge is fully inserted in said cartridge chamber;

a bolt being movable relative to the cartridge chamber and lockable with a locking device into a closed position, said bolt having a front bolt head with an outer contour and a recess formed in said front bolt head, said bolt head having a breech block, said breech block, in the closed position of the bolt, being held flush with said rear sealing surface and with the case bottom of the cartridge when the cartridge is fully inserted in said cartridge chamber;

a bolt holder containing said bolt and connected to said barrel; and a cartridge ejector disposed in said recess in said front bolt head and being movable from a closed position to an ejection position when said bolt is moved axially in said bolt holder, said cartridge ejector having a U-shaped plate shape matching said outer contour of said bolt head and further having a front end surface, said front end surface, when the bolt is in the closed position, sealing flush with said breech block against said rear sealing surface.

* * * * *